US005725081A

United States Patent [19]

Meeker

[11] Patent Number: 5,725,081

[45] Date of Patent: Mar. 10, 1998

[54] DIGITAL DEPOSIT AND DISPENSING SAFE

[75] Inventor: Scott H. Meeker, Temecula, Calif.

[73] Assignee: Phelps-Tointon, Inc., Vista, Calif.

[21] Appl. No.: 543,477

[22] Filed: Oct. 16, 1995

[51] Int. Cl.[6] ..... G07F 7/04

[52] U.S. Cl. ..... 194/206; 109/24.1; 109/53; 221/125

[58] Field of Search ..... 221/152, 153, 221/266, 125; 194/306, 207; 232/65; 109/24.1, 53–57

[56] References Cited

U.S. PATENT DOCUMENTS

| | | | |
|---|---|---|---|
| 452,635 | 5/1891 | Dieterich . | |
| 789,086 | 5/1905 | Diebel . | |
| 1,778,833 | 10/1930 | Norris . | |
| 2,311,632 | 2/1943 | Berger et al. . | |
| 2,323,681 | 7/1943 | Sangster et al. | 221/152 |
| 2,508,159 | 5/1950 | Haas . | |
| 2,922,546 | 1/1960 | Trulaske | 221/133 |
| 2,923,587 | 2/1960 | Zipf | 346/22 |
| 2,952,385 | 9/1960 | Stayton | 221/152 |
| 3,593,881 | 7/1971 | Paap | 221/3 |
| 3,648,020 | 3/1972 | Tateisi et al. | 235/61.78 |
| 3,806,710 | 4/1974 | Shigemori et al. | 235/92 SB |
| 3,963,900 | 6/1976 | Sawaguchi et al. | 235/61.73 |
| 4,000,800 | 1/1977 | Loucks, Sr. | 194/9 R |
| 4,190,066 | 2/1980 | Burnside | 133/4 R |
| 4,313,601 | 2/1982 | Graef et al. | 271/207 |
| 4,418,555 | 12/1983 | Uyeda | 70/366 |
| 4,447,714 | 5/1984 | Lundblad | 235/379 |
| 4,469,245 | 9/1984 | Fish et al. | 221/225 |
| 4,554,444 | 11/1985 | Hirose | 235/379 |
| 4,663,621 | 5/1987 | Field et al. | 340/825.31 |
| 4,717,044 | 1/1988 | Suzuki et al. | 221/130 |
| 4,745,784 | 5/1988 | Gartner | 70/277 |
| 4,877,235 | 10/1989 | Robinson et al. | 271/279 |
| 4,899,562 | 2/1990 | Gartner et al. | 70/277 |
| 4,922,837 | 5/1990 | McGunn | 109/46 |

(List continued on next page.)

FOREIGN PATENT DOCUMENTS

| | | | |
|---|---|---|---|
| 161431 | 2/1955 | Australia | 221/152 |
| 2217073 | 10/1989 | United Kingdom . | |

OTHER PUBLICATIONS

Centurion Deposit Corporation, TSBD 2018 Multi "Shutter–Slot" Depository, 1986.

Tidel Engineering, Inc., Carrollton, Texas, "This Doesn't Seem like Much Now", TACC Cash Dispensers (Referenced in Martin patents '157 and '967).

Armor Safe Technologies[1] "The TREASURY Digital Deposit and Dispensing Safe", Copyright 1993.

Armor Safe Technologies[1] "PosiCACHE Digital Deposit and Dispensing Safe", Copyright 1994.

Armor Safe Technologies[1] "ChangeBANK Digital Dispensing Safe", Copyright 1993.

Tidel Engineering, Inc., Carrollton, Texas, "Still Taking Chances With Your Cash Management", TACC Cash Deposit and Dispensing Safe (Referenced in Martin patents '157 and '967).

*Primary Examiner*—Lloyd A. Gall
*Attorney, Agent, or Firm*—Juettner Pyle Lloyd & Piontek

[57] ABSTRACT

A combination money deposit and dispensing safe, includes a generally box-like housing having a front door, and back and side walls forming a chamber defining a safe for securing money, a bill receiving apparatus mounted in the front door of the safe for receiving bills of various denominations, for validating the bills and for generating a signal indicative of the validation and determining the denomination of the bills and generating a signal proportionate to the denomination of each of the validated bills, a cash dispensing apparatus mounted in said front door of the safe, having multiple cartridges for containing units of cash for dispensing, a dispensing tray rotatably mounted at the bottom of each cartridge, a latch releasable in response to the signal to enable the manual operation of a dispensing tray of a cartridge of cash proportionate to the signal, and a manually operable handle for dispensing an enabled unit of cash.

18 Claims, 5 Drawing Sheets

U.S. PATENT DOCUMENTS

| | | | |
|---|---|---|---|
| 4,927,055 | 5/1990 | Groover | 221/67 |
| 4,940,162 | 7/1990 | Thie | 221/129 |
| 4,966,304 | 10/1990 | Kelly | 221/6 |
| 5,042,685 | 8/1991 | Moulding, Jr. et al. | 221/1 |
| 5,096,088 | 3/1992 | Grossi | 221/153 X |
| 5,110,009 | 5/1992 | Gartner et al. | 221/266 |
| 5,220,157 | 6/1993 | Martin et al. | 235/379 |
| 5,285,926 | 2/1994 | Falk et al. | 221/153 X |
| 5,340,967 | 8/1994 | Martin et al. | 235/379 |
| 5,460,294 | 10/1995 | Williams | 221/152 X |

FIG. 7
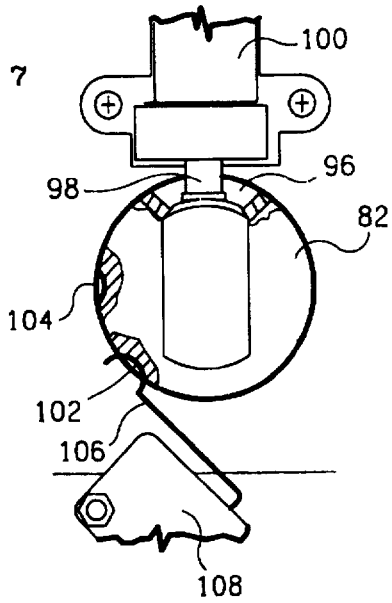
FIG. 9
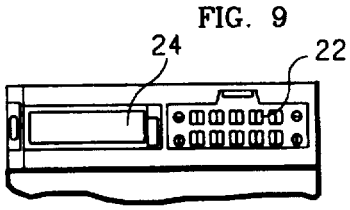
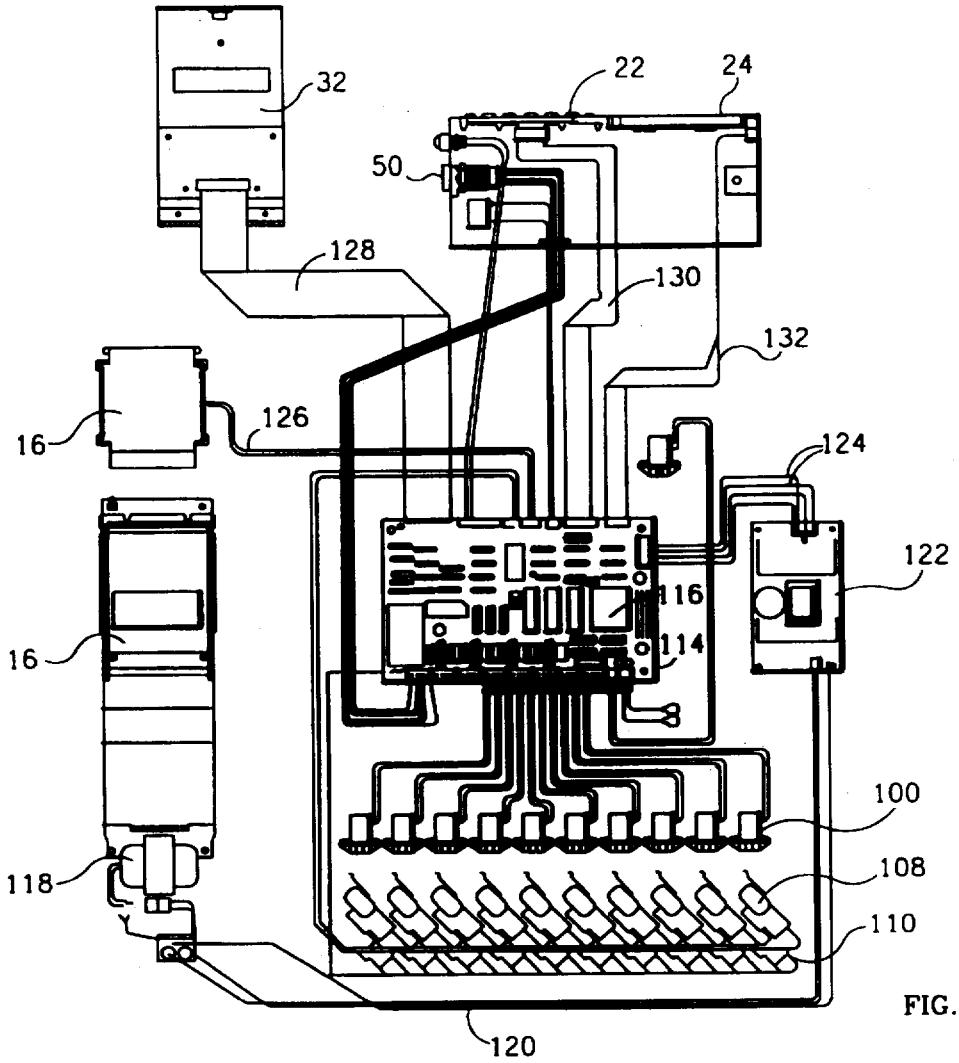
FIG. 8

DIGITAL DEPOSIT AND DISPENSING SAFE

BACKGROUND OF THE INVENTION

The present invention relates to money dispensing machines and pertains particularly to a combined deposit and dispensing safe.

Business establishments which handle a large number of cash transactions, require a large amount of coins and small bills to make change. Minimum amount of coins and small bills are normally maintained in the cash registers to make change. Accumulated cash in the form of bills are transferred to a safe periodically to reduce the risk in the event of robbery. Some of this cash is exchanged for coins and some merely deposited for security. However, in each instance a responsible person such as a manager or head cashier must be available to access the safe and dispense the necessary cash for change.

Systems have been recently developed which can dispense a certain amount of cash to cashiers. However, none of these systems have the ability to receive cash and account for the cash deposited and dispensed. Many of these systems also fail to provide adequate security to prevent embezzlement or theft of funds from the safe.

Therefore, there is a need for a reliable and effective system for safekeeping, receiving and dispensing of cash for businesses.

SUMMARY AND OBJECTS OF THE INVENTION

It is the primary object of the present invention to provide a reliable and effective system for safekeeping, receiving and dispensing of cash.

In accordance with the primary aspect of the present invention, a combination money deposit and dispensing safe comprises a generally box-like housing having a front, a back and a chamber for securing money, a bill receiving unit mounted in said front of said safe and having means for receiving and validating bills of any denomination and generating a signal in proportion to the denomination of said bill, a cash dispensing unit mounted in said front of said safe and having means responsive to said signal to enable the dispensing of cash proportionate to said signal, and a manually operable dispensing tray for dispensing an enabled unit of cash.

BRIEF DESCRIPTION OF THE DRAWINGS

The above and other objects and advantages of the present invention will become apparent from the following description when read in conjunction with the accompanying drawings wherein:

FIG. 7 is an enlarged detailed view of a portion of the cam and locking system of the dispensing trays;

FIG. 8 is a rear elevation view illustrating the wiring diagram connecting the major components of the embodiment of FIG. 1;

FIG. 9 is a top plan view of the key pad and LCD screen of the embodiment of FIG. 1.

DETAILED DESCRIPTION OF THE PREFERRED EMBODIMENTS

Figure 1:
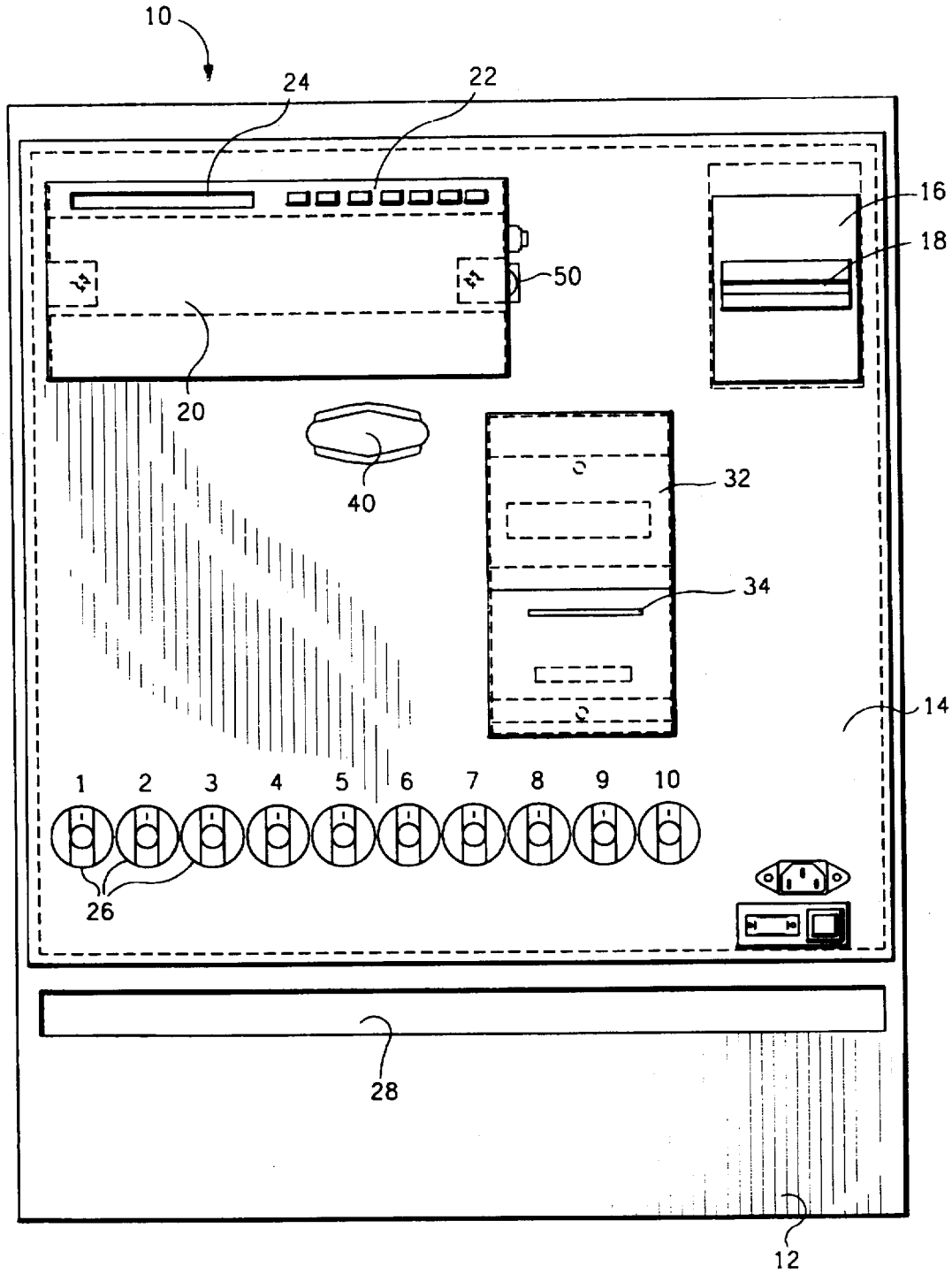
FIG. 1 is a front elevation view illustrating a preferred embodiment of the present invention.

Referring to FIG. 1 of the drawing, a safe embodying a cash management and handling system in accordance with the present invention is illustrated and designated generally by the numeral 10. The safe comprises a generally box-like housing having front, back, side, top and bottom walls forming or defining a secure chamber for safe storage and placement of cash and other securities. The safe in accordance with the invention is equipped with a system having a combination of functions defining a cash management system to enable the safe storage and retrieval of cash for a retail establishment. The illustrated embodiment has a front wall 12 including a door 14 which pivots along an axis at the lower edge thereof to open outward as will be subsequently explained.

The system embodies cash receiving and dispensing devices, preferably along with a central processing unit (CPU) with software for a certain degree of accounting. In the illustrated embodiment the cash receiving and validating unit 16 is mounted on the inside of the door and is accessible by way of a cash receiving slot 18 in the front of the door. The cash receiving and validating unit is an off the shelf item available from Rowe International Inc. in Rockwell, Tex. under the model number RBA-7. This unit accepts a bill and verifies it as a genuine bill or rejects it. If the bill is accepted it is read for its denomination, stashed in a storage box and a signal pulse emitting a credit valuation is initiated. This credit pulse is transmitted to a programmed CPU mounted on a circuit board within the safe which processes the signal and activates a dispensing cartridge for dispensing a container containing an equivalent amount of cash.

A user interface and control panel 20 is mounted on the front of the door and includes a key-pad 22 and LCD screen 24. The keypad enables the programming of the CPU and the entry of codes and commands by the user. The electronic system provides information and prompts the user on the LCD screen to select and rotate the corresponding knob to retrieve the cash unit.

A plurality of dispensing knobs 26, only one of which will be specifically described, is rotated by the operator to selectively dispense a unit of cash 27 into a retrieving tray 28 in the lower part of the safe housing or cabinet. The illustrated embodiment is equipped with a plurality of dispenser cartridges 30 which mount to the back of the safe door inside the safe for containing multiple units of cash of predetermined values for dispensing. The units of cash are tubes containing predetermined denominations of cash. In the illustrated embodiment the system is provided with ten cartridges with each loaded with multiple, such as ten, predetermined units of cash to be dispensed in response to the insertion of a bill. If there are no cash units equivalent in denomination to the bill inserted, the bill will be returned to the users. If a cartridge is empty the system will initiate a signal such as an audible buzzing to alert the user. The illustrated embodiment was designed primarily to provide change to cashiers. However, the system can be programmed to issue credit and/or dispense other units.

A printer 32 is mounted on the front of the door 14 and connected through the electronics of the system to print reports on paper dispensed through a slot 34. The printer may be any suitable printer such as a Citizens model number MD-910. The printer may be used to print any number of reports desired by the safe operator. The CPU may be programmed to provide any desired accounting information which may be provided via the printer.

Figure 6:
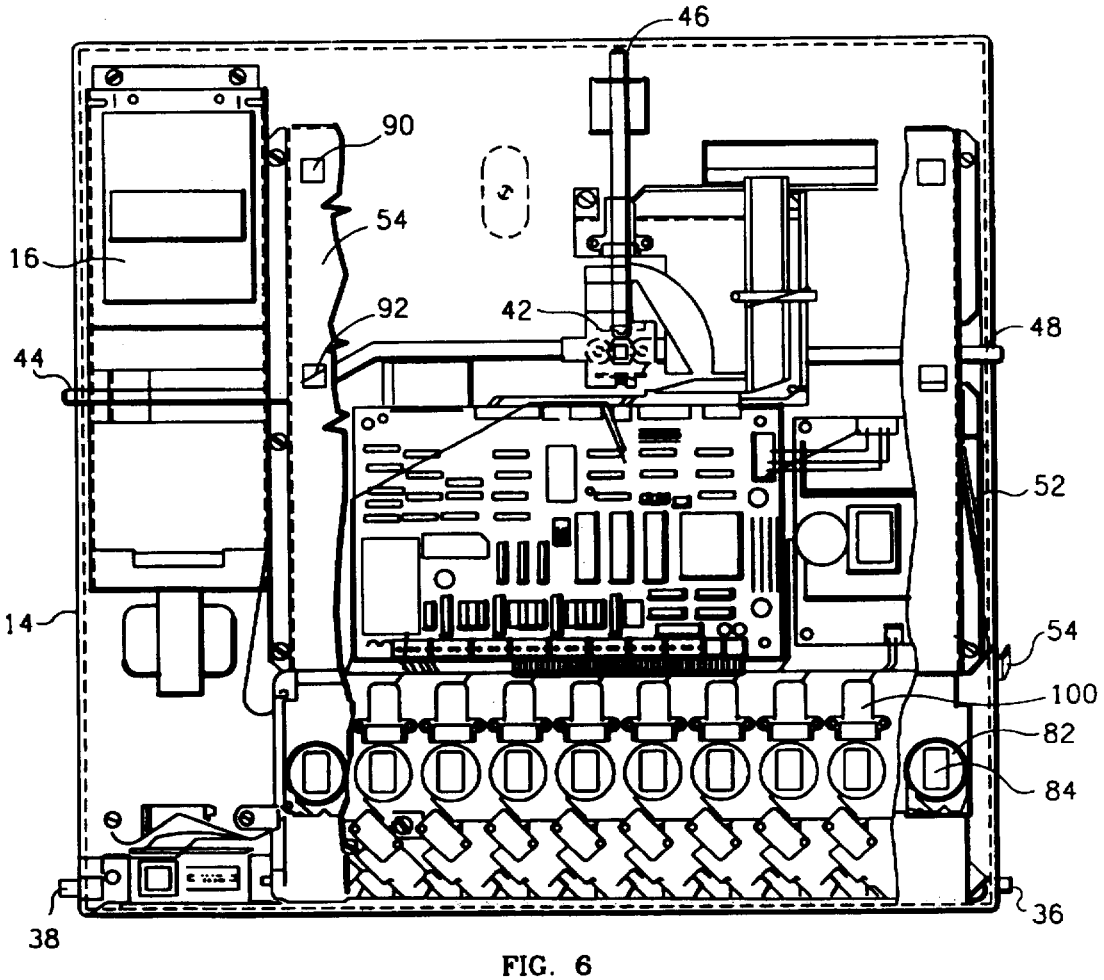
FIG. 6 is a rear elevation view with portions broken away to reveal the major components of the embodiment of FIG. 1.

The door 14 is pivotally mounted, such as by means of a pair of pins 36 and 38 at opposite sides of the lower edge thereof, and pivots forward to provide access to the interior of the safe. A locking system operated by an exterior handle 40 is connected through the door and a linkage plate 42 as shown in FIG. 6 to operate locking bolts 44, 46 and 48 to lock the door in a closed position. The lock system is maintained in the locked stage or condition and may be opened by entering a proper code on the keypad 22 which unlocks a solenoid lock to enable operation of the latch releasing handle 40. A key unlocking system, including a slot at 50 on the user interface panel enables the opening of the safe should a power failure occur. This system is operated by a suitable dry-cell battery.

Figure 2:
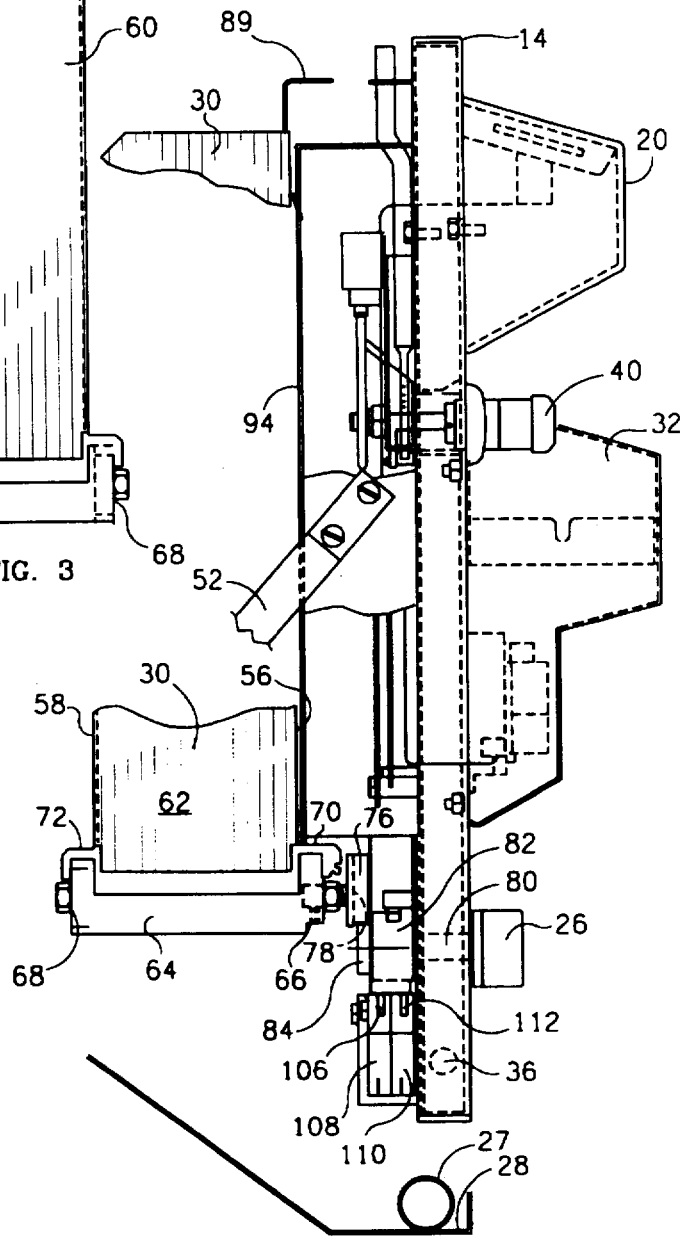
FIG. 2 is a side elevation view of the embodiment of FIG. 1.

A safety latch arm 52 is secured to a side of the door 14, as shown in FIG. 2 and includes a hook 54, as shown in FIG. 6 for latching to a side of the safe housing to support the door in a forwardly inclined position. The latch arm prevents the door from falling down against the front of the safe when the lock is released.

Figure 4:
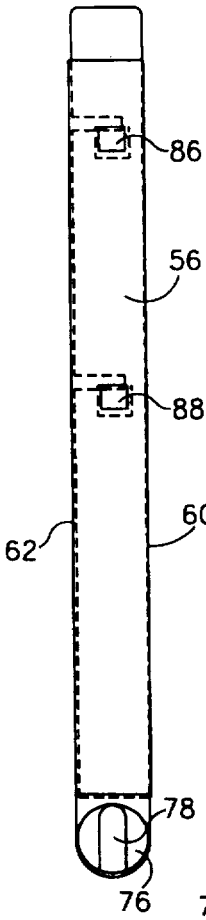
FIG. 4 is a front elevation view of the cartridge of FIG. 3.
Figure 3:
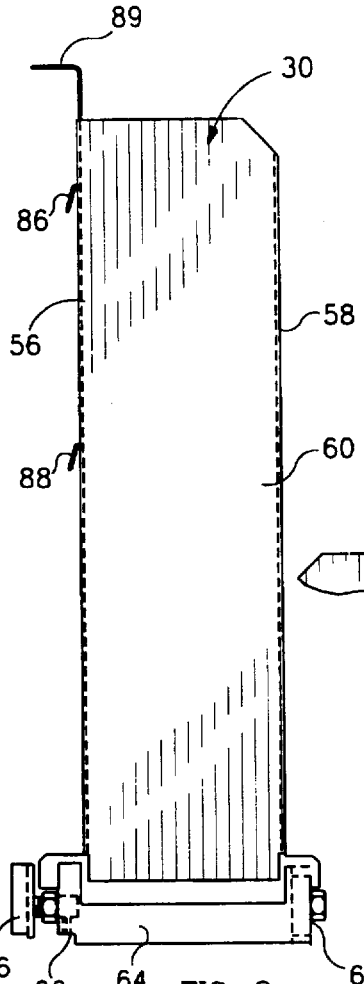
FIG. 3 is a side elevation view of the interchangeable cartridges of the embodiment of FIG. 1.

Referring now to FIGS. 3 and 4, a dispensing cartridge 30, having a tall, narrow box-like configuration is illustrated. The cartridge has an open top for receiving a plurality of units of currency, such as coins or bills placed preferably in a plastic tube. The cartridges may be formed of plastic or sheet metal and comprise a forward wall 56 which faces the door in the mounted position, a back-wall 58 and side-walls 60 and 62.

Figure 5:
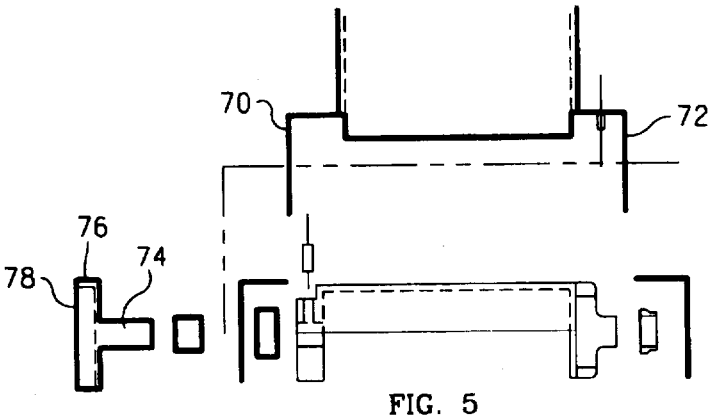
FIG. 5 is an exploded view of the dispensing tray of the cartridge of FIG. 3.

A rotatable dispensing tray 64 formed with a central semi-circular trough configuration with circular ends 66 and 68, as shown in FIGS. 3 and 5, is rotatably mounted in brackets 70 and 72 at the bottom of each dispensing cartridge. One end of the dispensing tray is provided with a rotatable drive-shaft 74, having a coupling disc 76 with a slotted key-way 78 therein. The dispensing tray 64 is normally disposed as shown in FIG. 3 with the top open and aligned with the open bottom of the dispensing cartridge 30 for receiving a tube of currency.

Each dispensing knob 26 as shown in FIG. 2 is rotatably mounted by means of a shaft 80 in the door of the safe and includes cam member 82 with a coupling key 84 for engagement with the coupling key-way 78 on a dispensing tray. Each cartridge is provided with mounting hooks 86 and 88 on the front wall 56 thereof for hooking into mounting slots 90 and 92 on the cover panel 94 on the back of door 14, as shown in FIG. 6. The panel 94 is provided with a pair of hooking slots or mounting slots aligned directly above each of the coupling shafts or keys 84 of each of the dispensing knobs 26. The dispensing cartridges 30 thus may be quickly and easily mounted in and removed from the safe. This enables the cartridges, for security purposes, to be loaded elsewhere and simply and quickly loaded into the safe.

As seen in FIG. 2, a lower portion of a cartridge is illustrated positioned directly above and ready to move down into coupling engagement with a dispensing knob assembly 26. As the cartridge is lowered with the hooks 86 and 88 moving into the mounting slots 90 and 92, the coupling slot or keyway 78 slides down over key 84 establishing a coupling. The cartridge is easily removed by reversing the above procedure. The cartridge is provided with a handle that can be grasped by hand for lifting and carrying it.

The system enables any number or combination of currency units or tubes to be loaded in any number of cartridges and mounted in the dispensing assembly. The CPU of the management system can then be programmed to identify the cash unit value of each cash unit in each of the selective cartridges. Thus, when a cashier inserts a $20 bill in slot 18 the system verifies the bill and if validated immediately activates a dispensing cartridge containing units of $20. The LED 24 then displays instructions to the operator to select and rotate a specified knob which thereby dispenses a roll containing $20 in certain denominations of cash.

Referring now to FIG. 7, some detail of the cam 82 is illustrated. The cam, as illustrated, includes a latching recess 96 in which a plunger 98 of a solenoid 100 engages to latch the dispensing tray against rotation. When a dispensing cartridge is enabled the solenoid 100 is activated pulling the latching plunger 98 upward clearing slot 96 and enabling the dispensing tray to be rotated by the dispensing knob 26. The cam 82 also includes cam recesses 102 and 104. Cam recess 102 is operative to enable a first switch arm 106 on a switch 108 to drop into recess 102. A second identical switch 110 is mounted directly behind switch 108 as shown in FIG. 7 and directly beside switch 108, as shown in FIG. 2 and includes an actuating arm 112 which drops into recess 104. This action controls movement of the plunger 98 back into the cam 82 for locking the dispensing tray against rotation.

Both switches are required to operate in sequence to signal that the dispensing tray has been fully actuated and the cash dispensed therefrom. Failure to rotate the dispensing cash unit sufficient to dump the cash unit actuates an audible alarm signalling that a tray has not been dispensed. Similarly, failure to rotate the dispensing handle back to the upright position also actuates an audible alarm signalling that the dispensing knob is to be rotated back to the ready position. At this position, the tray receives another unit of currency for dispensing.

Referring to FIG. 8, a wiring diagram of the system is illustrated. As illustrated in FIG. 8, the system includes a centrally mounted PC board 114 which has a CPU 116 such as an 8088 microprocessor available from Intel or any other suitable unit. The PC board mounts the usual electronics components for interfacing with the CPU for operating the various components of the system. The bill validating unit 16 has its own transformer 118 and is connected through a plurality of conductors 120 to the input terminals of power supply unit 122. A series of cables 124 connects the supply unit 122 to the PC board. As shown in section A—A at the left side of FIG. 8, the bill validating unit 16 is connected to the PC board by suitable conductors 126. A ribbon cable 128 connects the PC board 114 to the printer 32. A ribbon cable of multiple conductors 130 connects the key pad 22 to the PC board. Similarly the LCD 24 is connected by a ribbon cable 132 to the PC board. Each of the many solenoids 100 for each of the dispensing cartridges is connected to the PC board by its own conductor combination. Switches 108 and 110 are similarly connected to the PC board by a plurality of cables.

Figure 10:
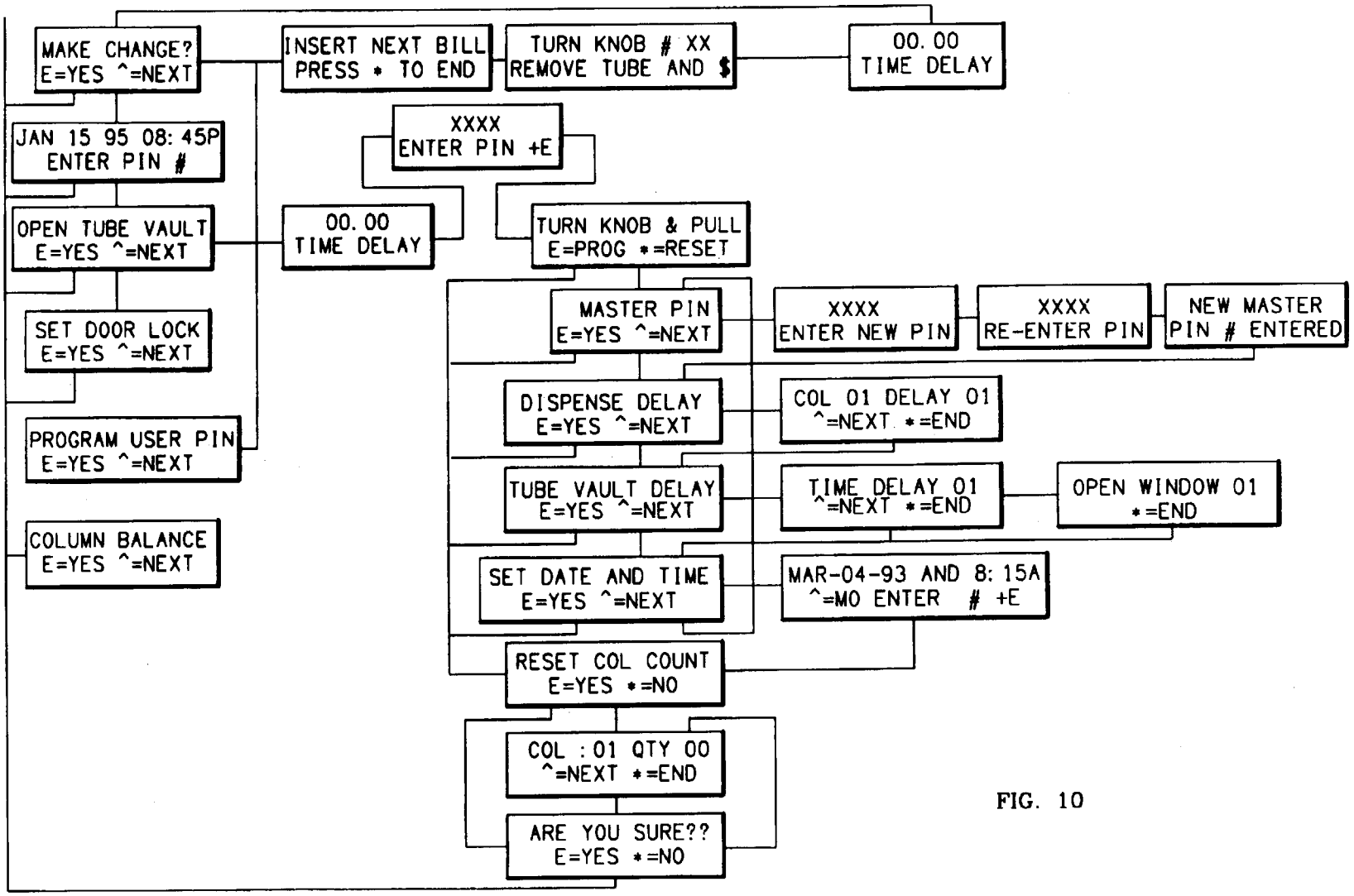
FIG. 10 is a functional block diagram of the embodiment of FIG. 1.

Referring to FIG. 10, a system flow diagram is illustrated, illustrating the overall function and operation of the controller operating system. The system can be programmed to operate in a number of different ways to suit the operator. For example, it can provide any delay between dispensing of change from 0–99 minutes. This enables the system to be programmed to frustrate robbery. The system can be programmed to require a PIN number at certain stages of the system for accounting purposes. This enables the system to be programmed to provide an accounting of cash deposited, received or exchanged by each cashier within the business. It can also be programmed to receive and credit cash or deposits without the necessity of dispensing an equal amount of change. It can be programmed to dispense a certain amount of cash under specified conditions without the deposit of cash. Thus, it can be programmed to operate in a large number of modes.

While I have illustrated and described my invention by means of specific embodiments, it is to be understood that numerous changes and modifications may be made therein without departing from the spirit and the scope of the invention as defined in the appended claims.

I claim:

1. A combination money deposit and dispensing safe comprising:

a generally box-like housing having a front, back and sides and defining a chamber for securing money;

a bill receiving unit mounted in said front of said housing and having means for receiving and validating bills of various denominations and generating a signal proportionate to the denomination of a validated bill;

a cash dispensing unit mounted in said front of said housing, said dispensing unit comprising a plurality of cash cartridges each adapted to contain a plurality of units of cash corresponding in denominational value to and constituting change for a respective denomination of the bills to be received and validated, each of said cartridges including a manually operable dispensing tray for dispensing units of cash from the respective cartridge one unit of cash at a time, said dispensing unit including means responsive to a proportionate signal from said bill receiving unit for enabling a single operation of the dispensing tray of a single cash cartridge that contains units of cash corresponding in denominational value to the denomination of the validated bill and to enable the dispensing of a unit of cash proportionate to said signal.

2. A safe according to claim 1, wherein said means responsive to a proportionate signal is a solenoid that releases a latch that normally latches the respective dispensing tray.

3. A safe according to claim 2 wherein each cash cartridge is vertically oriented and each tray is rotatably mounted at the bottom of the respective cartridge for dispensing units of cash by gravity.

4. A safe according to claim 1 wherein said means responsive to a proportionate signal is operative to actuate dispense limit means for limiting each manual dispensing tray to dispensing of a single unit of cash in response to a respective proportionate signal.

5. A safe according to claim 4 wherein said limit means includes latch means associated with and normally latching each dispensing tray against operation and responsive to a respective proportionate signal for releasing and enabling operation of the respective tray and for again latching the respective tray against operation following a dispense cycle.

6. A safe according to claim 5 wherein said limit means includes cam means on each said tray for actuating switch means for activating the respective latch means and for latching the respective tray following a dispense cycle.

7. A safe according to claim 1 wherein each of said cash cartridges is modular and removable from the dispensing unit and a dispensing tray is embodied in each said cartridge.

8. A safe according to claim 1 wherein said safe includes a control system including a CPU programmable for carrying out selected functions.

9. A combination money deposit and dispensing safe comprising:

a generally box-like housing having a front, a back and a chamber defining a safe for securing money;

a bill receiving unit mounted in said front of said safe and having means for receiving bills of various denominations, validating said bills, and generating a single proportionate to the denomination of each said bill;

a cash dispensing unit mounted in said front of said safe, said dispensing unit comprising a plurality of cash cartridges each adapted to contain a plurality of units of cash corresponding in denominational value to and constituting change for a respective denomination of the bills to be received and validated, each of said cartridges including a manually operable dispensing tray for dispensing units of cash from the respective cartridge one unit of cash at a time, latch means associated with each of said dispensing trays for normally prohibiting operation of the respective tray, said dispensing unit including means responsive to a proportionate signal from said bill receiving unit for disengaging the respective latch means and enabling a single operation of the dispensing tray of a single cash cartridge that contains units of cash corresponding in denominational value to the denomination of the validated bill and to enable the dispensing of a unit of cash proportionate to said signal, and means responsive to operation of the enabled dispensing tray and the dispensing of a unit of cash for reengaging the respective latch means and limiting operation of the enabled tray to dispensing of a single unit of cash.

10. A safe according to claim 9 wherein said cartridges are vertically oriented and separately mounted in said dispensing unit and a dispense tray is rotatably mounted at a bottom of each cartridge and integral therewith.

11. A safe according to claim 9 wherein said means responsive to a proportionate signal is a solenoid that disengages the respective latch means and said means for reengaging the respective latch means comprises dispense limit means actuated by the respective dispensing tray for de-energizing the solenoid to reengage the respective latch means and limit operation of the tray to dispensing of a single unit of cash.

12. A safe according to claim 11 wherein said limit means includes a pair of switches and cam means on the dispensing tray for actuating the pair of switches in sequence for deactivating said solenoid and latching said tray against rotation following a dispense cycle.

13. A combination money deposit and dispensing safe, comprising:

a generally box-like housing having a front door and back and side walls forming a chamber defining a safe for securing money;

a bill receiving apparatus mounted in said front door of said safe for receiving and validating bills of various denominations, said bill receiving apparatus having denomination sensing means for generating a signal proportionate to the denomination of each validated bill;

a cash dispensing apparatus mounted in said front door of said safe, said dispensing apparatus comprising a plurality of vertically oriented cash cartridges for respectively containing units of cash corresponding in denominational value to respective denominations of the bills to be received and validated, a dispensing tray rotatably mounted at the bottom of each cartridge for receiving and dispensing units of cash from the respective cartridge one unit of cash at a time;

latch means associated with each of said dispensing trays for normally prohibiting operation of the trays;

means responsive to a proportionate signal from said denomination sensing means for disengaging the respective latch means to enable a single manual rotation of the dispensing tray of a single cartridge that contains units of cash proportionate to said signal;

manually operable means for rotating the enabled dispensing tray for dispensing an enabled unit of cash; and dispense limit means associated with each of said dispensing trays for determining that the respective dispensing tray has been fully rotated and a unit of cash dispensed therefrom, for determining that the respective dispensing tray has been returned to its normal position for receiving a unit of cash, and for reengaging the respective latch means with the respective dispensing tray following return of the tray to its normal position for limiting each dispense cycle to a single unit of cash.

14. A safe according to claim 13 further comprising digital input means for overriding said signal and enabling dispensing of cash units in selected denominations.

15. A safe according to claim 13 wherein said unit of cash is a plastic tube containing cash of a predetermined amount.

16. A sate according to claim 13 wherein said safe includes a control system including a CPU programmable for carrying out selected functions.

17. A safe according to claim 13 wherein said means responsive to a proportionate signal is a solenoid that is energized to disengage the respective latch means and said dispense limit means includes cam means on the respective dispensing tray and a pair of switches operated in sequence by said cam means for deactivating the respective solenoid and reengaging the respective latch means.

18. A safe according to claim 13 wherein said front door is forwardly tiltable for gaining convenient access to said bill receiving apparatus and said cash dispensing apparatus, for retrieving validated bills from said bill receiving apparatus and for replenishing the supply of units of cash in said cash dispensing apparatus.

* * * * *